United States Patent [19]

McIntyre et al.

[11] 4,341,606

[45] Jul. 27, 1982

[54] METHOD OF OPERATING ELECTROLYTIC CELLS HAVING MASSIVE DUAL POROSITY GAS ELECTRODES

[75] Inventors: James A. McIntyre; Robert F. Phillips, both of Midland; Joseph D. Lefevre, Bay City, all of Mich.

[73] Assignee: The Dow Chemical Co., Midland, Mich.

[21] Appl. No.: 236,355

[22] Filed: Feb. 20, 1981

Related U.S. Application Data

[63] Continuation-in-part of Ser. No. 939,598, Sep. 5, 1978, Pat. No. 4,260,469.

[51] Int. Cl.[3] ..... C25B 1/34

[52] U.S. Cl. ..... 204/98; 204/128

[58] Field of Search ..... 204/98, 128, 284, 294

[56] References Cited

U.S. PATENT DOCUMENTS 4,035,255 7/1977 Gritzner ..... 204/128

4,086,155 4/1978 Jonville ..... 204/290 R

*Primary Examiner*—R. L. Andrews

*Attorney, Agent, or Firm*—James H. Dickerson, Jr.

[57] ABSTRACT

A process for operating an electrolytic cell having a relatively-massive dual porosity gas electrode particularly well suited and adapted for utilization as a vertically-disposed oxygen gas-bearing electrochemically reducing cathode in electrolytic cells wherein, for efficient and practical, commercially-large-scale-output operations, there are required to be employed substantial electrolyte liquid depths creating considerable head pressures generally greater than at least about 1 psi (ca. 0.69 dynes/cm$^2$) is comprised of distinct juxtaposed, contiguous, yet separate, diversely porous electrode body wall members or layer sections, one of which for immediate electrolyte contact and handling is of relatively finer pored structure and the other of which for immediate gas contact and handling is of relatively larger or coarse pored structure; the electrode being so embodied and characterizable for given application as to have a bubble point pressure that is larger than the summation of the hydraulic head pressure and the liquid capillary pressure in the coarse pore layer.

11 Claims, 2 Drawing Figures

Figure 1:
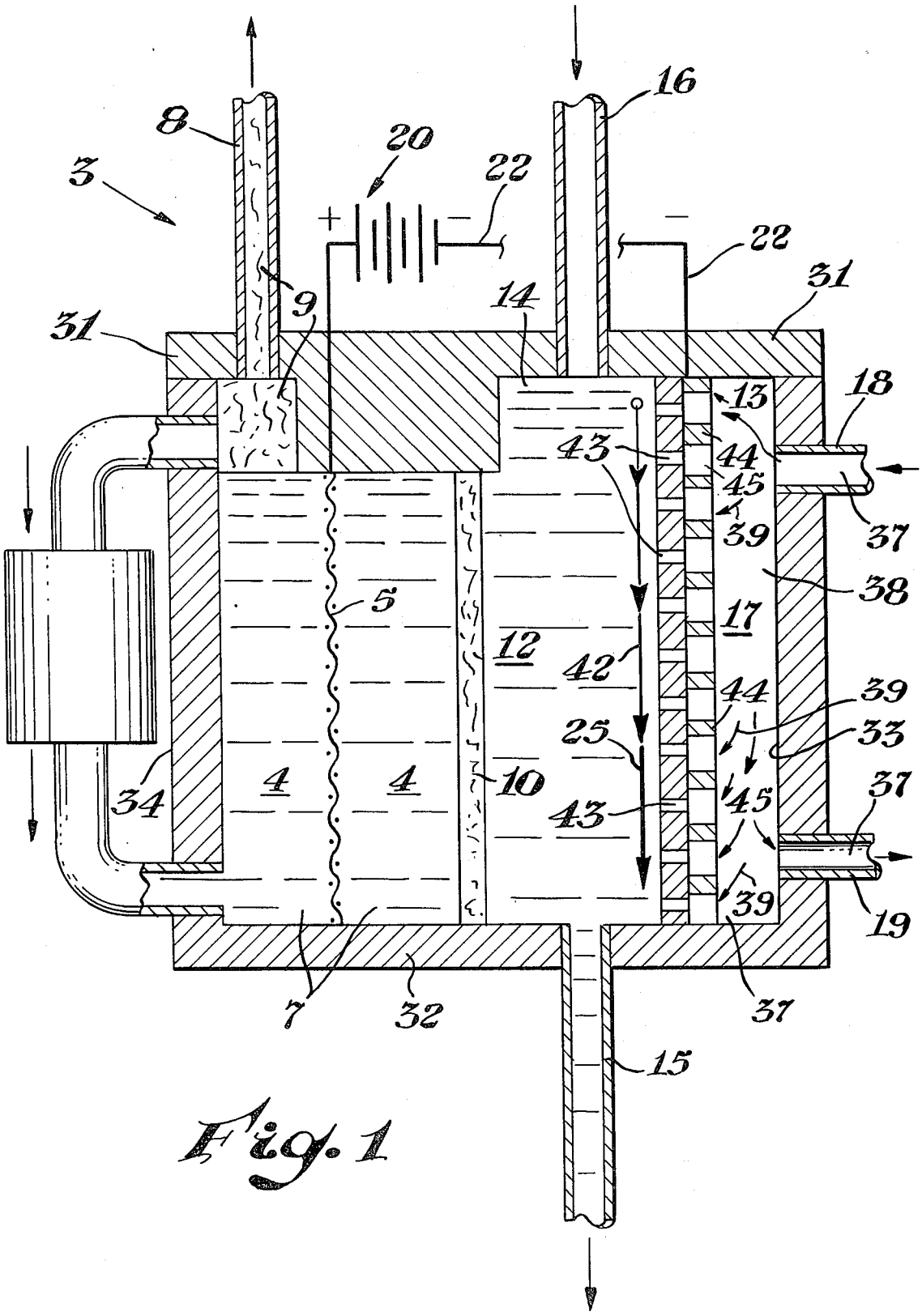

METHOD OF OPERATING ELECTROLYTIC CELLS HAVING MASSIVE DUAL POROSITY GAS ELECTRODES

CROSS-REFERENCE TO RELATED APPLICATION

This is a continuation-in-part application of copending application Ser. No. 939,598, filed Sept. 5, 1978 now U.S. Pat. No. 4,260,469.

BACKGROUND OF THE INVENTION

Gas electrodes, in which a gas is passed in contact with a suitable electrode conductor in the presence of an electrolyte solution are well known. Amongst several practical employments, such assemblies even find occasional application for use as reference electrodes.

In their typical and most popular utilizations, gas electrodes function in systems capable of generating electricity (such as fuel cells and the like) or for electrolysis purposes in which the electrode performs as a depolarized cathode (as in chlor-alkali and the like or equivalent and analogous product manufacturing operations). These gas electrode installations implement electrochemical reactions involving the interaction with and between three individual phases of a gas, a liquid (usually aqueous) electrolyte and electrons provided directly from a solid conductor surface, all of which are in necessary simultaneous respectively mutual contact in order to accomplish desired results. So that, with and for given unit geometric volumes, maximization can be realized of the available surface area on which the requisite three-phase contact is believed according to at least one theory to occur (thereby possibilitating greater current density obtentions with the given units), modern gas electrodes are made to be porous. Because, according to the indicated theoretical presumption, the reaction takes place on the interior interstitial surfaces of the porous electrode bodies, it is consequently felt to be important that the three-phase contact are for the reaction be kept in a stable and at least relatively precise location.

The means so far developed for localizing the site of the three-phase reaction within the passageways of porous electrode bodies have included one of three applicable ways of so doing, namely:

(A) To treat the pore interiors on the gas side of the electrode with a material (such as "Teflon," a fluorinated ethylene polymer) which is not wet by the electrolyte so that liquid is prevented for penetrating entirely through the electrode.

(B) To maintain the desired regional three-phase contact by very careful balance between gas pressure exerted and capillary pressure generated with the electrolyte solution which is possible by use of a usually metallic, porous electrode body fabricated so as to have a very narrow distribution of pore sizes.

(C) To use a dual porosity structure for the electrode body of, again, usually metallic construction wherein the layer designed to face the electrolyte has smaller pores than those in the adjacent, complementary layer by means of which it is possible to apply a gas pressure through the larger pored layer that is greater than the median electrolyte capillary pressure in the large pores but smaller than that in the small pore layer so as to maintain the three-phase contact sector within the interstitial passageways at least approximately in the vicinity of the joinder boundary of the layers; this sort of construction being easier to make than the variety described in the above paragraph (B) since not such a difficult to fabricate, narrow pore size distribution is demanded for each of the layers in the electrode.

Of hisotric note and interest, dual porosity electrodes of the type particularized in Paragraph (C) above were employed in various apparatus used in the so-called "Apollo" Space Program conducted by the National Aeronautics and Space Administration of the United States of America.

Various aspects relevant to the use of gas electrodes in galvanic and electrolysis mode applications, including oxygen depolarized cathodes in electrolytic cells, are amply demonstrated in, inter alia, U.S. Pat. Nos. 1,474,594; 2,273,795, 2,688,884; 3,035,998; 3,117,034; 3,117,066, 3,262,868; 3,276,911; 3,316,167; 3,377,265; 3,507,701; 3,544,378; 3,645,796; 3,660,255; 3,711,388; 3,711,396; 3,767,542; 3,864,236; 3,923,628; 3,926,769; 3,935,027; 3,959,112; 3,965,592; 4,035,254; and 4,035,255; and Canadian Pat. No. 700,933. A good description of dual porosity electrodes for fuel cell usage is set forth at pages 53–55 of "*Fuel Cells*" by G. J. Young (Reinhold Publishing Company, N.Y., 1960). All of the noted citations and all of the contents thereof are herein incorporated by reference, taking into account that the complete body of literature available as to this general subject matter (including dual porosity electrodes) is already vast and multitudinous.

As indicated, oxygen gas-bearing depolarized electrodes are of especial interest in commercial, large-scale chlor-alkali operations and analogous electrolyzations of other alkali metal or acid halides. In the electrolysis of common salt brine, for example, the reaction at the depolarized cathodic oxygen electrode in the alkaline media of the catholyte is:

$$O_2+2H_2O+4e^- \rightarrow 4OH^- \text{ with } E^\circ=0.401 \text{ v.}$$

In comparison, the cathode reaction in a traditionally conventional chlor-alkali cell is:

$$2H_2O+2e^- \rightarrow H_2+2OH^- \text{ with } E^\circ=-0.828 \text{ v.}$$

Thus, the use of an oxygen gas-bearing depolarized, dual porosity electrode for chlor-alkali electrolytic cells brings about a theoretically achievable electrical potential requirement saving of 1.229 volts. This, for practical purposes, translates to the possibility of very substantial reduction in and economization of power costs when reckoned from the basis of the usual relatively low voltages (frequently in the range of ca. 2–5 volts) at which a typical chlor-alkali diaphragm cell operates in order to effect the desired electrolysis and accommodate associated overvoltage requirements.

Nonetheless, there are certain considerable difficulties involved in the utilization for large-scale commercial manufacturing purposes (as in the chlor-alkali trade) of dual porosity gas electrodes. Probably most significantly problematical and perplexing of these is the frequent occurrence of bubbling or leaking of reactant gas under full electrolyte restraining pressure through at least the upwardly disposed electrolyte facing portions of a vertically emplaced electrode in truly big cell assemblies. In many commercial installations, the electrolyte is often contained for reasons of practical necessity in considerable depth (frequently as deep as 4 feet—ca. 1.2 meters—and deeper). With a head of such magnitude, the catholyte exerts a substantial hydraulic pressure (usually at least 1 psig and often on the order of 2–3 psig—ca. 0.09 to 1.38–2.07 dynes/cm$^2$—and greater). In other words, tall and massive electrodes introduce a new and important factor with which to contend; this being the non-inconsequential liquid pressure effect on the electrode simply due to the height of the electrolyte in the cell and its corresponding magnified head pressure. If the gas pressure is reduced to avoid bubbling in the upper portions of the electrode, the increasingly pressurized liquid towards the lower electrode portions overcomes its restaint by the applied gas. It then invariably leaks through the pores in that area causing other major and contrary problems of electrolyte loss into the bottom of the gas chamber from which the gas is pressed (or even into the gas supply system). This often tends to inoperate or at least considerably diminish the effectiveness and productive capacity of the cell.

Leaking is, plainly, extremely undesirable. Not only does it tend to materially interfere with and diminish overall reaction efficacy (since it loses the advantageous electrochemical and reduced voltage requirement reasons for keeping the reaction in a desirable stable interstitial area), it occasions, amongst other things, escape of reaction gas which is either lost or, if collected, must be handled through recovery and reprocessing units for subsequent re-use. In any event, leaking unavoidably and to quite appreciable extents can increase the cost of the operation.

Analogous considerations apply as to leakage and other problems in large-scale fuel cells and the like battery devices involving use of dual porosity electrodes.

The heretofore known and employed dual porosity electrodes have been and are generally of relatively small size of invariable less than about 18 inches (ca. 45.7 centimeters) in height when vertically utilized, and usually even much shorter than that. In cells of such relatively small-scale dimensional magnitudes, the hydraulic electrolyte pressure heads involved are negligible and of no practical concern or consequence insofar as is relevant to gas leakage and associated problems. Rarely do they substantially approach even as small as a 1 psig value. In fact, the diminutive dual porosity gas electrodes which have so far appeared have not been uncontrollably hampered by bubbling or leakage problems because of the explained, embodied dimensional limitations which avoid serious inherent susceptibility thereto. Thus, there really has been no specialized prior art addressed to the encumbrance and impediments of bubbling and/or leaking in dual porosity electrodes of massive and relatively large-scale body design and construction.

The basic characteristics and operational principles and limitations of porous, including dual porous, electrode design and utilization practice are so widely comprehended by those skilled in the art that further elucidation thereof and elaboration thereon is unnecessary for thorough understanding and recognition of the advance contributed and made possible to achieve by and with the development(s) of the present invention.

FIELD AND OBJECTIVES OF THE INVENTION

The present invention pertains to and resides in the general field of electrochemistry and is more particularly applicable to an improved gas-bearing, particularly an oxygen gas-bearing, electrode with a dual porosity body structure having massive, large scale constructional proportions adapted to vertically function without leakage or bubbling in a relatively deep supply of contacting electrolyte which exerts substantial, downwardly-increasing hydraulic pressure head against the electrode body, all along the lines generally indicated in the foregoing and more fully and particularly delineated in the following. The contemplated large, dual porosity electrode is adapted to operate in a large capacity cell with utmost electrochemical and power efficiencies and with stably located three-phase reaction regions ensured within the electrode. Utilization of the electrodes of the instant invention, and the discovery upon which it is based, is calculated to circumvent and avoid the considerable disadvantage and difficulty of trying to balance the pressure between gas and liquid phases in a porous electrode or wetproof portions of electrode pores to attempt to preclude liquid passage therethrough. The provision and use of such an advantageous and beneficial, massive dual porosity electrode arrangement for large scale cell applications are amongst the principal aims and objectives of the invention.

SUMMARY OF THE INVENTION

An electrolytic process has been developed which uses a layered cathode. An aqueous electrolyte is contacted with at least a portion of a first layer of the cathode. The first layer has a plurality of passageways passing through the first layer and connecting with a plurality of passageways which pass through a second layer. The electrolyte exerts a hydraulic pressure on the cathode, while the passageways of the first layer have a first capillary pressure and the passageways of the second layer have a second capillary pressure which is lower than the first capillary pressure. An oxygen-containing gas is contacted with at least a portion of the second layer at a pressure greater than the sum of the second capillary pressure and the hydraulic pressure of the electrolyte and less than the first capillary pressure. Then, electrolysis of the electrolyte is performed.

ILLUSTRATED REPRESENTATION OF THE INVENTION

Figure 2:
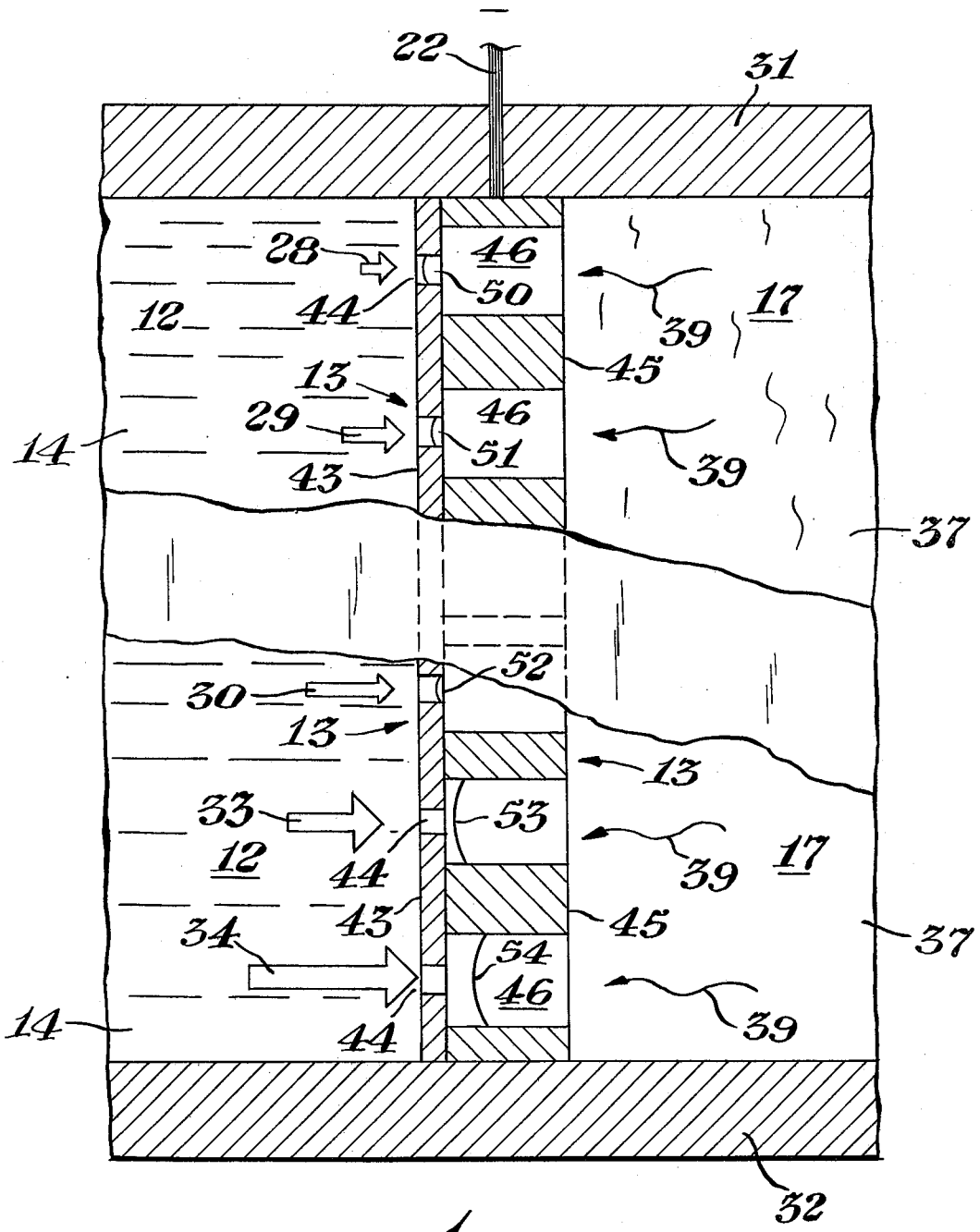

Further features and characteristics of the dual porosity, multiple layer gas electrode development in accordance with the present invention, and the way in which it so nicely achieves and fulfills the presently-intended aims and objectives and contributes to the art for which it is pertinent, are more readily apparent and evident in the ensuing specification and description, taken in conjunction with the accompanying drawing, wherein (using like reference numerals for like parts):

FIG. 1 is a schematic, largely-simplified, exaggerated elevational view, mostly in section, of an appropriate large-size cell utilizing a relatively tall, large scale electrode pursuant to the invention; and FIG. 2 is a view in fanciful, enlarged, broken-away, cross-sectional elevation of the part of a cell in which the massive dual porosity electrode is situated.

PARTICULARIZED EXEMPLIFICATION OF THE INVENTION

With initial reference to FIG. 1 of the drawing, there is shown an electrolytic cell, identified generally by the reference numeral 3. This, as a matter of explanatory convenience, may be for the production of a halogen (such as chlorine) from a corresponding acid (such as hydrogen chloride) or alkali metal chloride (such as sodium chloride) or even in many situations where economically affordable for production of other end products from diverse acids and salts as from sulfates, nitrates, etc. For purposes of immediate illustration, the cell 3 is pictured to be electrolyzing sodium chloride brine into chlorine and sodium hydroxide.

The depicted cell 3 is intended to represent a large-scale, high-volume output facility. It includes an anode compartment 4 with an anode 5, at which the oxidation reaction occurs, positioned therein. This is in spaced juxtaposition with a cathode comparmtment 12. Therein positioned is a tall dual porosity cathode electrode in accordance with the present invention, generally identified by reference numeral 13, at which the reduction reaction occurs.

The dual porosity electrode 13, constructed and functioning as is generally indicated in the foregoing, and more particularly described and explained in the following, stands between and partitions the catholyte solution 14 in the cathode compartment 12 from the oxygen-bearing gas chamber 17 containing the pressurized gas supply 37 for the electrode. Cathode electrode 13 has a first layer section or wall 43 containing a multiplicity of fine pores or small interstitial passageways 44 which face and is in contact with the catholyte 14 and a second layer section or wall 45 containing a multiplicity of coarse pores or large interstitial passageways 46 and is in contact with the gas 37. Probably not all, but at least a substantial majority if not the almost entire preponderance of the fine pores 44 are in matching electrode body-traversing communication with at least most of the coarse pores 46 so at to provide a multiplicity of continuous passageways through both contiguously adjoining electrode wall members 43 and 45. In numerous instances, a given coarse pore 46 may connect with more than a single fine pore 44 in the resultant interconnected pore network.

An asbestos diaphragm or ion-exchanging membrane or screen mesh separator 10, consistent with well-known technology, is centrally positioned in the cell to divide or separate anode compartment 4 from cathode compartment 12.

Cell 3 is made up with top and bottom sections 31 and 32, respectively, side walls 33 and 34 and front and back walls (not shown). Typically, cell 3 further includes a source of sodium chloride brine (not shown) and a means 6 to feed the brine into the anode compartment 4 and maintain the anolyte 7 at a predetermined and suitably operable sodium chloride concentration, as desired. Gaseous chlorine 9 is removed from anode compartment 4 by any suitable means, such as conduit 8, which is connected in an appropriate venting communication with the compartment in order to safely and efficiently afford the desired withdrawal and recovery of the halogen product.

The dual porosity, depolarized cathode 13 is spaced apart from side wall 33 of the cell 3 to form an intermediate opening or gas compartment 17. The oxidizing gas 37, such as air, oxygen-enriched air, oxygen, ozone (or the like or equivalent) is forced through inlet tube 18 into, preferably, the upper portion of the compartment 17 and passed in intimate contact with an outer face to coarse pore-containing layer 45 of the cathode 13. The oxidizing gas, following the overall flow pattern through compartment 17 depicted by the directional arrows 37 therein, is then withdrawn from the plenum volume thereof in the gas compartment through outlet means 19 for disposal or recycle, depending upon the practice most expedient and preferred under the particular operating conditions being followed. The portion of the gas immediately pressing into the large pores 45 is fancifully illustrated by the directional arrows 39.

Depending on the nature of the particular electrolyte(s) and anode involved in a system, the base material for both of the layers 42 and 44 of the dual porosity cathode 13 may be either metallic or non-metallic in nature. Carbon or graphite, especially when provided with a catalytically active surface, is often a suitable non-metallic base, while such metals and oxides thereof as tantalum or titanium, copper, various ferrous alloys and metals of the platinum group including gold, iridium, nickel, osmium, rhodium, ruthenium, palladium, platinum, and silver (or compositions, alloys and platings thereof) including, as an illustration, a suitably porous copper substrate that is silver plated. In any event, the electrode body material has, inherently or by treatment or modification (such as with platings, coatings and so forth), to be resistant to chemical attack—at least during cell operation—by the contacting oxygen and electrolyte material that is utilized.

As mentioned, the electrode is most preferably catalytically active to most effectively produce the desired oxygen reduction in the presence of water within the three-phase regions of reaction inside the dual porosity interstitial passageways of the electrode. Of course, and at least theoretically, the catalyst activity need only be on the interior pore surfaces of the highly apertured electrode body to provide the necessary effect. This allows for the beneficiating utilization of catalytic coatings, platings or other depositions on and of the pore surfaces to render to desired reaction-promoting capability a material for an electrode body construction that is not intrinsically catalytic. While there are a number of workable catalyst substances for the various electrochemical reactions possible to achieve by practice of the present invention, the mentioned platinum group metals and many of their compositions, especially the oxides, generally have quite good potential for this function. Silver and gold are good examples of this, as well as nickel. The latter, for reasons of availability, relative economy, desirable physical characteristics and ready workability, is frequently desirable for use in one or another way and with or without plating as the material employed for electrode body construction. When a plated-on catalyst layer is utilized, such as one of silver on copper, it is desirably in an as thin as possible, yet substantially if not completely continuous, deposit.

Usually, the porous layer sections 43 and 45 are in the form porous sintered or analogously compressed and interbonded metal or other suitable compositional powdered, fibrous or otherwise finely particulated material.

The anode construction may be done as desired, but it is usually in the form of either a solid body or some foraminous, grid-like structure, such as a screen. Excepting that it usually is undesirable for it to be comprised of any ferrous materials, especially in acidic media, the anode can sometimes be made of the same general materials as used for the cathode. Oftentimes, with advantage, it may also be a structure of the type known in the art as a dimensionally stable anode comprised of base members of tantalum or titanium and other equivalents thereof coated or plated with such materials, for example, as at least one metal or oxide of the platinum group metals including the same elements or above-identified for constituting the inert anode surface.

It may also be beneficial to utilize efficient circulating means (such as agitators, impellers, recirculatory pump installations, aerators or gas bubblers, ultrasonic vibrators and so forth, not shown) to continuously move the catholyte 14 and avoid stagnations thereof within the cathode compartment 12. This promotes thorough cathode contact by substantially all of the catholyte. The rate of such catholyte movement should be sufficient to ensure adequate repetitive and nearly, if not completely, total liquid contact of the cathode interface yet not so intense as to cause any physical injury to or disruptment of the separator element 10.

During cell operation, the catholyte 14 becomes increasingly enriched in its concentration of sodium hydroxide. This co-product can be removed in regulated fashion to keep catholytic caustic content at a controlled, predetermined strength. To this end, caustic-rich catholyte is withdrawn from catholyte chamber 12 for subsequent recovery and usage by means, not shown, through outlet conduit 15.

If and when an ion exchange membrane is used as a separator, make-up water is admitted coincident with catholyte withdrawal for catholyte composition balancing through inlet conduit 16 feeding into the catholyte chamber.

Cell operation in and for typical commercial installations can normally be still further ameliorated by regulated control of the catholyte head (i.e., the vertical difference, if any, between the upper liquid surfaces of the anolyte and the catholyte). When an ion exchange membrane is used as the separator element, it is ordinarily advantageous as to have the surface of the catholyte at a higher level that that of the anolyte surface. Preferably, this differential is between about 1 inch (2.5 or so centimeters) and about 3 feet (0.9 or so meter). On the other hand, when a flow-through diaphgram separator is employed, the anolyte level should be sufficiently higher than the catholyte level to facilitate maintenance of such a liquid flow rate through the separator element as will tend to keep the sodium hydroxide concentration in the catholyte at a constant value.

The electrical energy necessary to conduct the electrolysis in cell 3 is obtained from a power source 20 connected to energy transmission or carrying means such as aluminum or copper or equivalent conduits, bus bars or cables 21 and 22 to respectively provide direct electrical current to the anode 5 and cathode 13.

As will be readily apparent to those skilled in the art, a cell of the type illustrated in FIG. 1 is readily adaptable to be operated in the galvanic mode in a way quite analogous to that above described for an electrolysis mode function; an appropriate anode (such as zinc) material and a suitably cooperative electrolyte (such as aqueous sodium hydroxide) being utilized for the purpose with, in general, no separator element 10 being utilized and the power source 20 being obviously eliminated and replaced by a means for collecting and/or utilizing the thereupon generated electrical power.

The characteristics and operating action of a massive dual porosity electrode in accordance with the present invention is additionally brought forth in FIG. 2 of the drawing which is to be considered in supplemental conjunction with FIG. 1. The cathodic electrode 13 consists of the distinct, yet conjoint, individually apertured layer sections 42 and 44 which are fabricated and composed as above explained. Frequently, for various reasons including a usually greater physical strength in the fine pore layer, the thickness of layer section 42 is normally chosen to be less than that of layer section 44, although taking all factors into account there is no requirement for that in any given instance of electrode construction.

It is to be taken into account that in their procedure through the respective electrode walls in which they are contained, both the fine and coarse pores have ordinarily individually and complexly varying sinuous or serpentine, winding and frequently coiled or corkscrew-like in either relatively regular and/or diversely volute fashion, possibly even thick and thin cross-sectional, commonly indirect and/or indefinite and frequently formed or branch-tunneled sorts of pattern route or path following. The multiplicity of diversely sized fine and coarse pores usually jointly and severally assumed some such geometry in their almost invariably meandering style of traverse of the part of the composite porous electrode body structure in which they are respectively situated. Thus, the individual pore lengths are seldom of the same actual path length as the direct thickness of the layer section being penetrated, generally tending to be much longer than the layer thickness itself.

As figuratively indicated by the enlarging, vertically-disposed arrow 25 in FIG. 1 and the downwardly increasingly larger, horizontally-directed arrows 23, 29, 30, 33 and 34 in FIG. 2, the pressure head of catholyte 14 increases with depth. The gas portion 39 immediately pressing into large pores 45 is, of course, under a relativey constant pressure. In a relatively deep bath of catholyte, it does not require that the gas pressure at the top of electrode 13 (where the catholyte head pressure is at or approaching zero) be as great as at the electrode bottom (where liquid head pressure is greatest or approaching its maximum) in order to keep catholyte out of the electrode body or from seeping or leaking therethrough into the gas chamber 17. Conversely, gas bubbling or leakage at or towards the top of the tall electrode is more likely to occur with given gas pressure and catholyte depth than at or towards the bottom. Furthermore, it is disadvantageous to have a situation where the opposing gas-involving and liquid-involving pressures are in at least approximate balance in the central vertical portions of the electrode, as in the vicinity of arrow 30, while at the same time having the given constant gas pressure as depicted by arrows 39 being excessive at the top (as at arrow 28) so as to cause gas bubbling in upper portions of the electrode and insufficient at the bottom (as at arrow 34) so as to permit liquid leaking or seepage in lower portions of the electrode or, for that matter, to have any substantial and deleterious condition and extent of partial or complete gas bubbling and/or liquid leaking, if any, during cell operation.

At the same time and as has been delineated, it is considered to be quite desirable to maintain stable the region(s) of the three-phase reaction within the interconnecting, differently-sized fine and coarse interstitial passageways within the overall body of the electrode at or about the boundary vicinity of the wall sections. This is portrayed by the respective menisci 50, 51, 52, 53, and 54 (with greatly exaggerated relative positioning illustrated) which, in descending order, are formed as the liquid/gas interfaces within the interconnected fine and coarse pores 43 and 45 at about the boundary of layer sections 42 and 44, with their precise relative loci believed to be usually proceeding from within the porules in layer 42 toards and into the coarse pore orifices 45 with increasing catholyte head pressure.

All this is effectively achieved by use of correlated and cooperatively effective pore size ratios in the electrode so selected as to ensure meeting the mentioned criterion that the bubble point of the composite electrode body throughout all points of its vertical elevation be larger at any given point than the sum there of the hydraulic head pressure, if any, of the catholyte and the liquid fluid-constraining capillary pressure in the coarse pores. As explained and for purposes of electrode design, head pressure is negligible at the top of the electrode and can be ignored but is considerable at the bottom and must be given and treated with ample consideration. In this way, a massive dual porosity electrode can be fabricated to accommodate literally any commercially attractive and practical depth of catholyte bath for a large-volume producing cell to achieve the desired fluid-constricting ends using the oxygen-bearing gas involved at a constant operating pressure.

Satisfactory pore size dimension selections to make are nicely demonstrated by the calculation considerations and equational form parameters set forth below.

The head pressure in a given liquid bath at any given normal or reasonable operating temperature is expressed by the Formula:

$$P_{head}=\rho gh \quad \text{(I)}$$

wherein

P is the pressure in dynes/cm$^2$, $\rho$ is the density of the liquid in gms/cm$^3$, g is a gravitational constant equalling 980 gms/cm/sec$^2$, and h is the liquid height (head) in cm.

The capillary pressure of the pore is expressed by the Formula:

$$P_{cap}=\frac{2\gamma\cos\theta}{r},$$

wherein

P is the pressure in dynes/cm$^2$, $\gamma$ is the fluid (liquid) surface tension in dynes/cm, $\theta$ is the contact angle, and r is the pore radius in cm (taking into account that this may represent an approximate and median or equivalent nominal measure in pores with other than true circular cross-sections).

Application of Formulae (I) and (II) is made in the following way to cover a dual porosity electrode having a given average or nominal 5 micron radius coarse pore layer therein to be employed in a chlor-alkali cell using an electrode having a height of 72 inches (ca. 183 cm) handling an aqueous caustic catholyte containing about 20 weight percent of NaOH dissolved in water (this solution consisting primarily of 244 gms/l of the caustic and being 6.1 molar in strength) with the value of $\rho$ being 1.15 gms/cm$^2$ and that for $\gamma$ about 80 dynes/cm:

$$P_{head}=1.15\times980\times183 \text{ or } 2.06\times10^5 \text{ dynes/cm}^2;$$

and $$P_{cap}=\frac{2\times80\times1}{5\times10^{-4}} \text{ or}$$

-continued $$3.2\times10^5 \text{ dynes/cm}^2.$$

Therefore, the applied gas (oxygen) pressure must be greater than the summation of $P_{head}$ plus $P_{cap}$ or $5.6\times10^5$ dynes/cm$^2$ which, upon conversion by the factor $1.45\times10^{-5}$, equals 7.5 psig.

Near the top of the electrode, $P_{head}$ approximates zero so that in order to avoid gas bubbling at such elevation the bubble point of the fine pore layer must be greater than about 7.6 psig. Accordingly, pursuant to Formula (II), the fine pores must have an at least approximate or average and nominal radius value ($r_f$) of:

$$r_f=\frac{2\times80}{5.26\times10^5}=3\times10^{-4}\text{ cm},$$

which is to say that at least the nominally small pore radius must be less than 3 microns.

As a generality almost without exception, the maximum nominal radius (or equivalent) size of the porules in the fine pore layer of the electrode is calculable by the Formula (wherein $r_c$ is the nominal radius—or next best equivalent size dimension in irregularly and/or non-circularly cross-sectioned passageways—of the coarse pores in the contiguous layer of the structure):

$$r_f=\frac{2\gamma\cos\theta}{\rho gh+\frac{2\gamma\cos\theta}{r_c}} \quad \text{(III)}$$

Reducing the foregoing to a more empirically concrete basis, the nominal diameter measure of the porules 43 in a massive dual porosity electrode in accordance with the present invention that is adapted to cope without gas bubbling or electrolyte leakage therethrough under maximum electrolyte head pressures that are substantially greater than at least 1 psig is advantageously in a range of average or approximate measure lying nominally between about 0.1 and about 3 microns with the thickness of the electrode layer 42 penetrated thereby being between about 10 mils and about 60 mils (ca. 0.254 and 1.52 millimeters) with the nominal coarse pore 45 diameter in layer section 44 being between about 8 and about 12 microns in the wall member that is between about 20 and about 90 mils (ca. 0.508 and 3.04 millimeters). More advantageously in electrode bodies having a minimum height of at least about 4 feet, the associated respective nominal pore diameters and associated radii and electrode section layer thickness are: for the fine pore layer, an at least nominal diameter between about 1 and 3 microns in an about 15 to 35 mil (ca. 0.381 to 0.889 millimeters) of thickness wall layer section; and, for the coarse layer, an at least nominal diameter between about 9 and about 11 microns in an about 20 to 60 mil (ca. 0.508 to 1.524 millimeters) of thickness wall layer section.

As is immediately apparent and deductive in the foregoing, the ratio of the total electrode body thickness to the vertical height of the electrode is usually very small. Without any limitation or unnecessary restriction thereto and merely for illustrative purposes of impression, it can be reckoned from the above that, when using a 4-foot tall electrode for the comparison, the vertical height of the structure is between minimums of about 1600 to about 320, preferably from about 1370 to about 500 times as high as is the thickness of the complete composite electrode body, thickness ratio ranges between the fine pore layer thickness and the coarse pore layer thickness may also vary over wide relative proportions, depending upon the particularly involved structural characteristics and strengths of material features of the given involved layers and particular use applications being handled. Typical nonlimiting figures along this line are illustrated by ratios wherein the fine pore layer thickness is from only about 1/9 to 2/3 times the coarse pore layer thickness, sometimes in a 4-foot tall electrode, taken as a reference standard, being from about $\frac{1}{4}$ to $\frac{3}{4}$ times as much as the fine pore layer thickness relative to that of the coarse pore layer.

As an ordinary generality, the bubble point pressure of dual porosity electrodes that are of a height of at least about 4 feet should generally be at least about 10 psig (ca. 6.9 dynes/cm$^2$). From this, it can be seen as another rule of thumb generality that, for most cases and with any particular and ordinary practical-to-employ catholyte of given density (or specific gravity), the bubble point pressure of embodiments of the present massive electrode development should gradually increase on the rate order per lineal added vertical foot of increasing electrode height of about $2\frac{1}{2}$ psig$\pm$10 percent.

A good teaching work illustration and indication of practice of the present invention was observed using a flat section of dual porosity, porous sintered powdered nickel electrode material that was in the form of a flat, 8 inch to a side (ca. 20.32 centimeter) square. The fine pore layer therein was about 40 mils thick with nominal pore size diameters of about 1 micron. The coarse pore layer had pores with nominal diameters of about 10 microns in an appropriate 50 mil thick layer. The electrode structure, mounted in a "Plexiglas" frame, was placed in contact with a typical aqueous effluent from a chlor-alkali cell (e.g., ca. 100 gms/l NaOH, ca. 175 gms/l NaCl). Under these conditions, the bubble point of the electrode was about 13 psig which is to say that 13 psig differential gas pressure had to be applied to the gas side of the electrode before bubbles would appear on the liquid side. However, only about 1–2 psig of gas pressure had to be applied in order to prevent cell effluent from making substantial penetration into the coarse pore region.

Now then, if the given electrode material were contained in a 72 inch (ca. 173 centimeters) high structure, the hydraulic head pressure near the bottom of the electrode would be about 3 psig. This adds directly to the capillary pressure so that a gas pressure of about 5 psig would be required to maintain the same gas/liquid pressure balance as with the smaller symbolic test electrode. At the top of a 72 inch electrode, there is an essentially zero hydraulic head pressure. Thus, if the bubble point there were not greater than about 5 psig, gas would bubble through. But, since the tested dual porosity electrode material had a bubble point that was on the order of 13 psig, no gas bubbling problem would be encountered in a 72 inch high electrode made thereof when an adequate gas pressure is applied against and into the coarse pore layer of the structure to prevent liquid leakage at the bottom thereof.

Electrodes according to the present invention almost invariably achieve noteworthy and meritorious reductions in power requirements and cell voltage needs in large-scale, high-volume, generally commerical cell installations in which they are employed, of at least one-third of that necessary for comparable conventional cells of given, comparable producing and output ratings and capacities.

Many changes and modifications can readily be made and provided in various adaptations and embodiments in accordance with the present invention without substantially departing from the apparent and intended spirit and scope of same relevant to the instantly contemplated dual porosity electrode development and provision. Accordingly, the invention and all in pursuance and accordance with same is to be taken and liberally construed as it is set forth and defined in the hereto-appended claims.

What is claimed is:

1. An electrolytic process comprising (a) contacting at least a portion of a first layer of a multi-layered cathode with an aqueous electrolyte, wherein the electrolyte exerts a hydraulic pressure on the cathode; said first layer having a plurality of passageways passing therethrough and connecting with a plurality of passageways passing through a second cathode layer; wherein the passageways of the first layer have a first capillary pressure and the passageways of the second layer have a second capillary pressure which is lower than the first capillary pressure;

(b) contacting at least a portion of the second layer with an oxygen-containing gas at a pressure greater than the sum of the second capillary pressure and the hydraulic pressure of the electrolyte and less than the first capillary pressure; and (c) electrolyzing the electrolyte.

2. The process of claim 1 wherein the maximum hydraulic pressure of the electrolyte in a cell containing the multi-layered cathode is at least about $2\times10^5$ dynes/cm$^2$.

3. The process of claim 1 wherein the gas pressure is at least about $2\times10^5$ dynes/cm$^2$.

4. The process of claim 1 where the first capillary pressure is at least about $2\times10^5$ dynes/cm$^2$.

5. The process of claim 1 where the first layer has a thickenss of from about 0.4 to about 0.9 millimeters.

6. The process of claim 1 where the second layer has a thickness of from about 0.5 to about 3 millimeters.

7. The process of claim 1 where the passageways of the first layer have an average diameter of from about 1 to about 3 microns.

8. The process of claim 1 where the passageways of the second layer have an average diameter of from about 8 to about 12 microns.

9. The process of claim 3 wherein the gas pressure is at least about $5\times10^5$ dynes/cm$^2$.

10. The process of claim 4 wherein the gas pressure is at least about $5\times10^5$ dynes/cm$^2$.

11. An electrolytic process comprising (a) contacting at least a portion of a first layer of a multi-layered cathode with an aqueous brine solution, wherein the maximum hydraulic pressure of the brine in a cell containing the multi-layered cathode is at least about $2\times10^5$ dynes/cm$^2$; said first layer having a plurality of passageways passing therethrough and connecting with a plurality of passageways passing through a second layer; wherein the passageways of the first layer have a capillary pressure of at least about $5\times10^5$ dynes/cm$^2$ and the passageways of the second layer have a capillary pressure of less than about $5\times10^5$ dynes/cm$^2$;

(b) contacting at least a portion of the second layer with an oxygen-containing gas at a pressure which is at least about $2\times10^5$ dynes/cm$^2$ and less than the capillary pressure of the passageways of the first layer; and (c) electrolyzing the brine solution.

* * * * *

UNITED STATES PATENT AND TRADEMARK OFFICE

CERTIFICATE OF CORRECTION

PATENT NO. : 4,341,606

DATED : July 27, 1982

INVENTOR(S) : James A. McIntyre, et al.

It is certified that error appears in the above—identified patent and that said Letters Patent is hereby corrected as shown below:

Col. 1, line 40, delete "are" and insert --area--.

Col. 1, line 50, delete "for" and insert --from--.

Col. 2, line 8, delete "hisotric" and insert --historic--.

Col. 3, line 39, delete "invariable" and insert --invariably--.

Col. 3, line 61, delete "is" and insert --in--.

Col. 4, line 7, delete "head" and insert --heads--.

Col. 5, line 14, delete "comparmtment" and insert --compartment--.

Col. 5, line 65, delete "to" and insert --of--.

Col. 7, line 38, delete "diaphgram" and insert --diaphragm--.

UNITED STATES PATENT AND TRADEMARK OFFICE

CERTIFICATE OF CORRECTION

PATENT NO. : 4,341,606

DATED : July 27, 1982

INVENTOR(S) : James A. McIntyre, et al.

It is certified that error appears in the above—identified patent and that said Letters Patent is hereby corrected as shown below:

Col. 8, line 32, delete "relativey" and insert --relatively--.

Col. 9, line 1, delete "toards" and insert --towards--.

Col. 9, line 40, after the formula add --II--.

Col. 11, line 33, delete "appropriate" and insert --approximate--.

Col. 11, line 64. delete "commerical" and insert --commercial--.

Col. 12, line 37, delete "thickenss" and insert --thickness--.

Signed and Sealed this

Ninth Day of November 1982

[SEAL]

*Attest:*

GERALD J. MOSSINGHOFF

*Attesting Officer* *Commissioner of Patents and Trademarks*